US005279006A

United States Patent [19]

Teng

[11] Patent Number: 5,279,006

[45] Date of Patent: Jan. 18, 1994

[54] PLAY YARDS FOR INFANTS

[76] Inventor: Jerry M. S. Teng, 1037 Indiana Ave., South Pasadena, Calif. 91030

[21] Appl. No.: 936,798

[22] Filed: Aug. 28, 1992

[51] Int. Cl.[5] ..... A47D 7/00

[52] U.S. Cl. ..... 5/99.1; 5/981

[58] Field of Search ..... 5/98.1, 98.3, 99.1

[56] References Cited

U.S. PATENT DOCUMENTS

| | | | |
|---|---|---|---|
| 1,211,730 | 1/1917 | Lucas . | |
| 1,374,333 | 4/1921 | Stotler et al. . | |
| 1,413,068 | 4/1922 | Stotler et al. . | |
| 1,630,941 | 5/1927 | Hood . | |
| 1,782,217 | 11/1930 | Stoddard . | |
| 2,287,907 | 6/1942 | Schettler, Jr. . | |
| 2,464,866 | 3/1949 | Holtz . | |
| 2,486,054 | 10/1949 | Morse | 5/98.1 X |
| 2,486,067 | 10/1949 | Schroeder . | |
| 2,490,296 | 5/1947 | Fournier . | |
| 2,498,203 | 2/1950 | Fischer . | |
| 2,561,637 | 7/1951 | Rex . | |
| 2,569,937 | 10/1951 | Lindgren . | |
| 2,607,052 | 8/1952 | LeRoy . | |
| 2,617,999 | 11/1952 | Mitchell . | |
| 2,629,110 | 2/1953 | Fournier . | |
| 2,659,903 | 11/1953 | Hagelfeldt . | |
| 2,784,420 | 3/1957 | Moltane . | |
| 2,901,755 | 9/1959 | Wood, Jr. . | |
| 2,908,021 | 10/1959 | Fulton . | |
| 2,922,169 | 1/1960 | Werner . | |
| 2,942,750 | 6/1960 | Neely . | |
| 3,091,249 | 8/1960 | O'Neil . | |
| 3,165,760 | 1/1965 | Abajian . | |
| 3,183,528 | 5/1965 | Jacobs et al. . | |
| 3,430,273 | 3/1969 | Stillwaugh . | |
| 3,605,139 | 9/1971 | Lorentz, Jr. . | |
| 3,789,439 | 2/1974 | Berg et al. . | |
| 3,924,280 | 12/1975 | Vaiano . | |
| 4,008,497 | 2/1977 | Badon . | |
| 4,008,499 | 2/1977 | Wren et al. . | |
| 4,044,411 | 8/1977 | Peterson . | |
| 4,069,524 | 1/1978 | Carlo . | |
| 4,070,716 | 1/1978 | Satt et al. . | |
| 4,073,017 | 2/1978 | Stevens . | |
| 4,186,454 | 2/1980 | Cone . | |
| 4,202,065 | 5/1980 | Sullivan . | |
| 4,357,735 | 11/1982 | Saint et al. . | |
| 4,376,318 | 3/1983 | Cirillo . | |
| 4,538,309 | 9/1985 | Gunter . | |
| 4,561,128 | 12/1985 | Zimmerman . | |
| 4,561,138 | 12/1985 | Hwang . | |
| 4,573,224 | 3/1986 | Saint . | |
| 4,688,280 | 8/1987 | Kohus et al. | 5/99.1 |
| 4,703,525 | 11/1987 | Shamie . | |
| 4,811,437 | 3/1985 | Dillner et al. | 5/93.1 X |
| 4,848,793 | 7/1989 | Huspen et al. . | |
| 4,934,025 | 6/1990 | Mariol | 16/347 |

FOREIGN PATENT DOCUMENTS

| | | |
|---|---|---|
| 952496 | 8/1974 | Canada . |
| 43051 | 8/1887 | Fed. Rep. of Germany . |
| 481037 | 7/1929 | Fed. Rep. of Germany . |
| 1557841 | 1/1969 | France . |
| 2361846 | 3/1978 | France . |

*Primary Examiner*—Michael F. Trettel

*Attorney, Agent, or Firm*—Brobeck, Phleger & Harrison

[57] ABSTRACT

The present invention employs a swivelable locking member which is pivotally connected to upper frame supports on a play yard. The frame of the play yard also employs vertical supports whose spacing is maintained by a number of lateral extending members. Complementary inner and outer support members are employed to maintain the shape of the play yard and relative position of the structural members of the play yard. Alternatively, a motion inhibiting insert may be placed between adjacent lateral extending members. This, combined with the swivelable locking bracket, ensures easy pivot assembly or disassembly of the present invention, and ensures that the play yard will not accidentally collapse.

17 Claims, 5 Drawing Sheets

FIG. 6
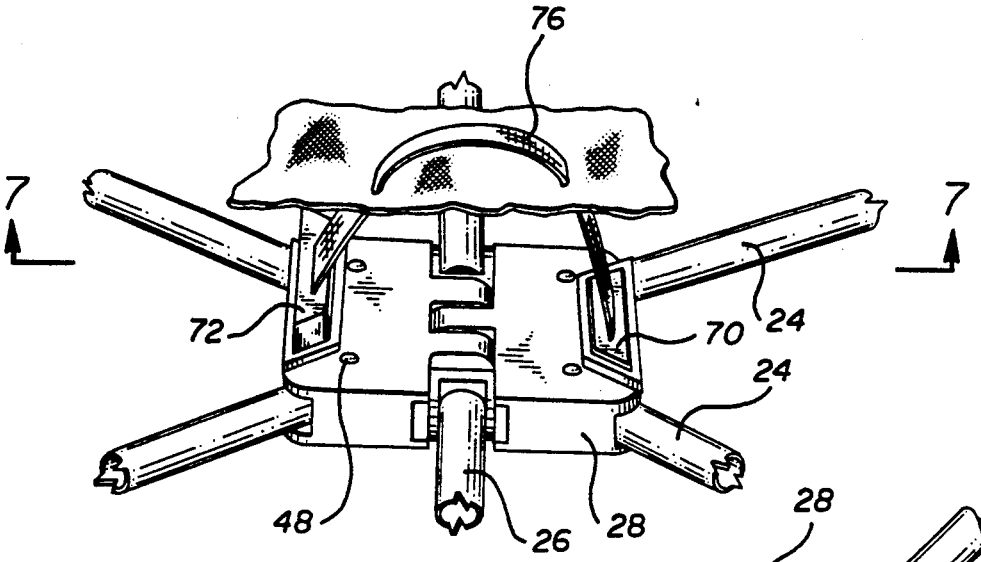
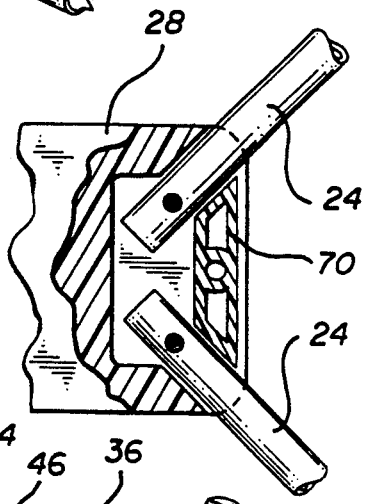
FIG. 8
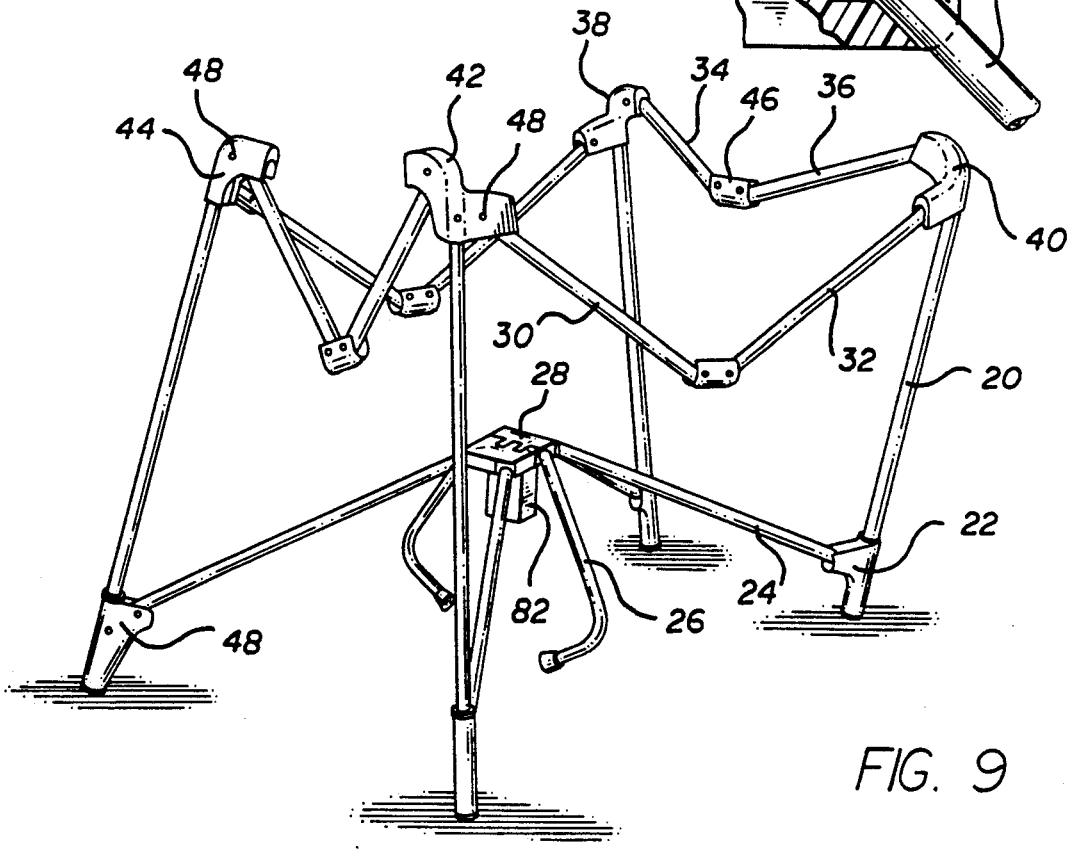
FIG. 9

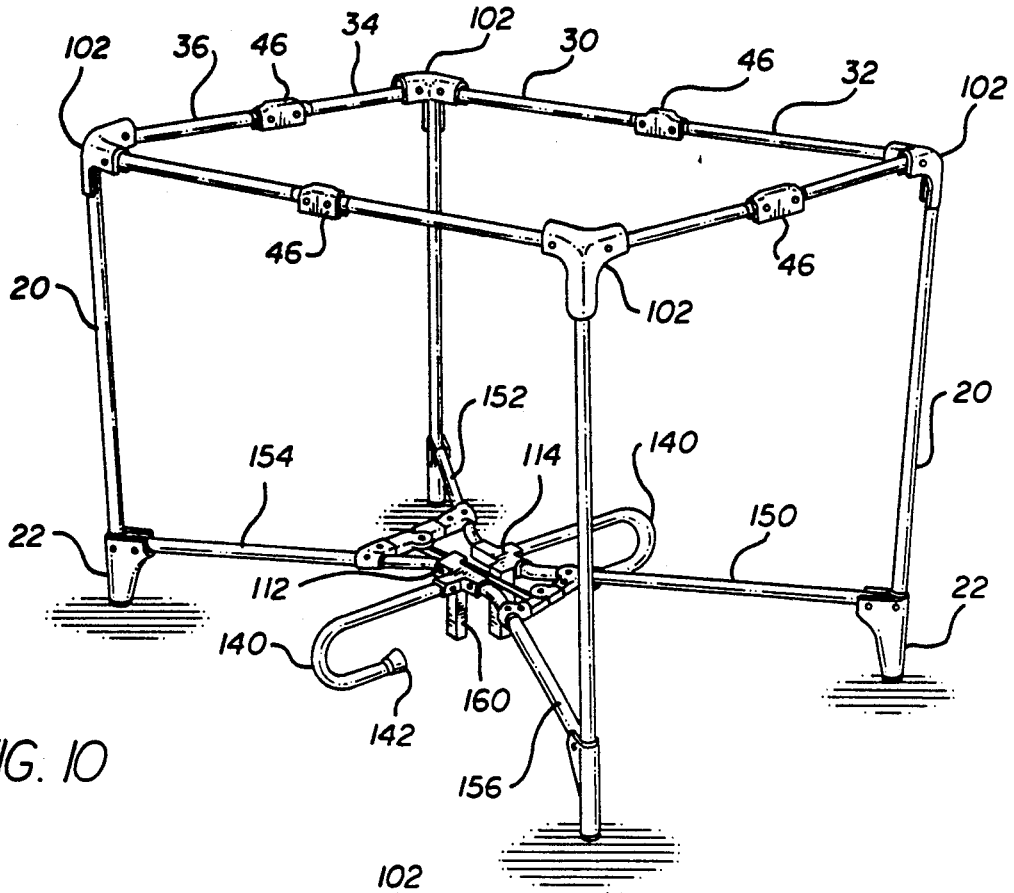
FIG. 10
FIG. 11
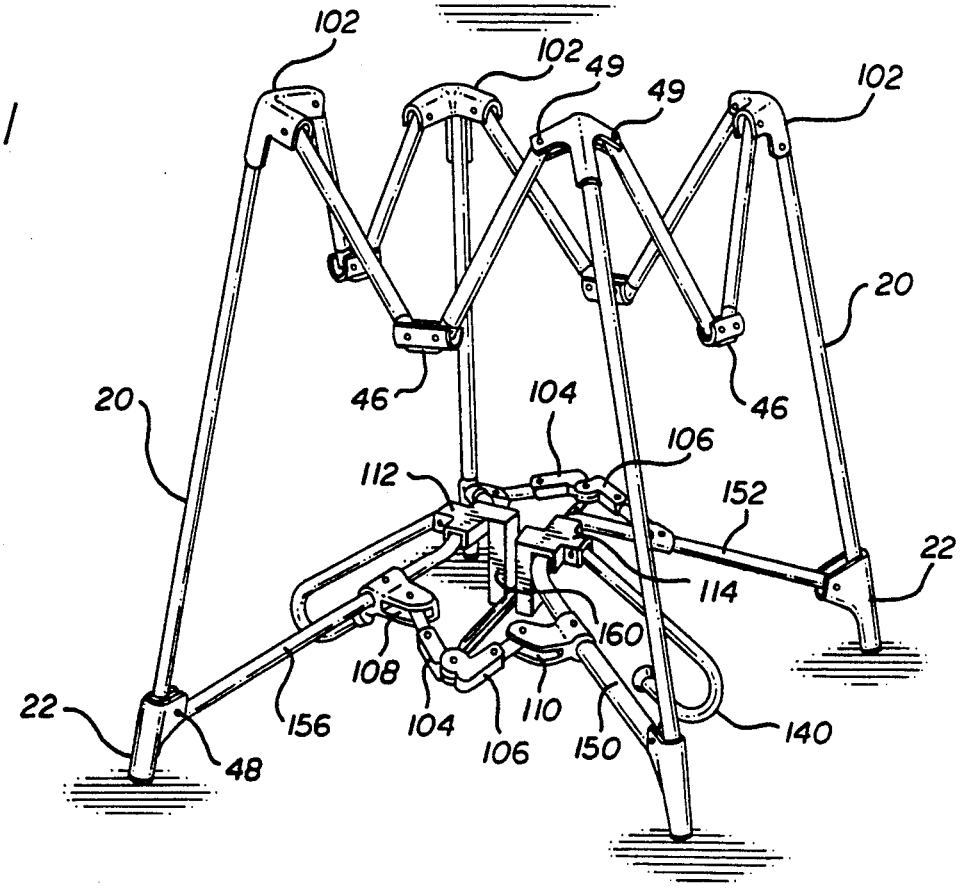

PLAY YARDS FOR INFANTS

FIELD OF THE INVENTION

The present invention relates generally to foldable play yards. More specifically, the present invention relates to an apparatus for ensuring the structural integrity of a foldable play yard once the play yard has been assembled.

BACKGROUND OF THE INVENTION

There are numerous types of collapsible play yards, or other walled structures that keep an infant confined within a limited space, yet which allow freedom of movement so that the infant or small child can play or move around. Permanent type play yards are usually set up at home or at a fixed location and require a substantial amount of time to disassemble and reassemble in order to relocate the play yard. This makes it impractical to move a permanent play yard on a regular basis.

Permanent type play yards tend to be large and cumbersome, making movement or storage of permanent type play yards unwieldy and difficult. As a result, numerous portable play yards have been designed. Play yards must be sturdy in order to contain an infant or young child without collapsing on the child while he or she is playing within the play yard. The play yard must also possess a substantial degree of structural integrity in order to accommodate an infant or child who will frequently pull on or push against the play yard that surrounds him. Further, the play yard must not expose the child or infant to rough or sharp edges where a child may be cut, or to movement of the apparatus, which could pinch a child's hand or foot.

Numerous collapsible or portable play yard designs have been produced over the years in an attempt to achieve a perfect play yard design which provides a sturdy yet portable play yard that does not expose the infant or child to any sharp or rough edges, or other areas in which a child may be injured. Of note amongst these is U.S. Pat. No. 4,688,280 issued to Cohus. The Cohus design employs a central base member to which four rods are pivotally attached. Each of these rods extends to each of the four corners of the foldable play yard assembly. At each of the corners, a vertical post is rotated upwards to provide support for a surrounding fabric enclosure. No structure is provided between any of the four vertical posts along the upper lip of the play yard. As a result, an infant or child can pull on the fabric enclosure thereby lowering the wall of the foldable play yard assembly. The central base member of Cohus allows the four legs to pivot outward and establish the corners of the play yard. No locking mechanism is present to ensure that the legs remain in the desired corner positions.

Another design is seen in U.S. Pat. No. 4,070,716 issued to Satt. The Satt design provides six vertical support legs that support a base and side wall enclosure. The side walls are hinged to collapse inward to the center of the play yard. The hinged portion is formed of a U-shaped piece of material that is riveted to longitudinal bars. The open end of the U is pointed outward. This design ensures vertical stability, and prevents the play yard from being expanded outward by force applied from the inside of the play yard in an outward direction by a child or infant. The U bracket is prevented from collapsing inward towards the center of the play yard solely by the structural strength of the remainder of the play yard. The play yard has a complimentary hinge arrangement at each of the corners in order to allow the play yard to be collapsed. No vertical support is provided at any of the corners of the Satt play yard. The arms of the Satt design are free to collapse inward until resistance is encountered by the remainder of the play yard frame.

Cirillo, U.S. Pat. No. 4,376,318 employs similar U-shaped brackets on opposite ends of a portable play yard design. The Cirillo structure is supported only at the four corners. Similar to Satt, Cirillo allows the outer wall of the play yard to be folded inward in order to collapse the play yard. Cirillo also suggests the possibility of using an independent sleeve that is placed over the hinged portion of the play yard structure in order to prevent the play yard from collapsing by maintaining structural rigidity. U.S. Pat. No. 2,901,755 issued to Wood also employs hinge covers.

Dilner in U.S. Pat. No. 4,811,437 employs a similar U-shaped bracket, but modified the ends of the lateral rod so that the open portion of the U-shaped bracket could be rotated to face downward. Dilner employs a spring loaded assembly in order to ensure that the lateral rods do not separate from the vertical support structure, yet remain rotatable.

None of these inventions provide an easily collapsible play yard that can contain a child with absolutely no threat of the play yard collapsing, or which absolutely guarantees that a child will not gain to access to collapsible or foldable parts which may injure the child.

SUMMARY OF THE INVENTION

It is accordingly an object of the present invention to provide a collapsible or foldable play yard that avoids the problems encountered in prior art devices.

Specifically, it is an object of the present invention to provide a portable, collapsible, or foldable play yard that cannot be collapsed or folded unintentionally by the action of a child playing within the play yard, or by an adult or other person having incidental contact with the play yard.

It is a further object of the present invention to provide a collapsible or foldable play yard that is easily collapsible and compact for transportation or storage.

It is a further object of the present invention to provide a foldable or collapsible play yard that is sturdy and secure when unfolded to contain an infant or child.

The present invention provides a collapsible or foldable play yard that includes an upper and lower frame structure pivotally connected to vertical corner supports. The upper frame contains a number of segments that are permanently joined together. Locking members located within the upper frame maintain the shape of the play yard, and prevent undesirable collapse thereof. The locking members operate by rotating the locking member and immediately adjacent frame only, without the need to rotate the structure of the play yard, or the need for complex, spring loaded pivots. The lower frame structure is maintained by lateral extension bars which are held in place by two sets of support members which each have locked and unlocked positions. The sets of support members may be operated independently of each other, or together.

Alternatively, the vertical supports are connected to a central housing located under the play yard by structural members that are hinged at the vertical support and the central housing. Play yard support is provided beneath the central housing. Additional structural members are hingedly connected to the central housing to provide additional stability to the play yard when it is opened. The central housing contains insert segments to prevent undesired lateral motion by any of the members extending from the central housing to the vertical supports. A handle may be attached to the central member in order to release the structural members and allow the play yard to be collapsed or folded.

BRIEF DESCRIPTION OF THE DRAWINGS

FIG. 6 is an isometric view of the central member of the present invention.

FIG. 8 is an isometric view showing the frame of the play yard in a partially collapsed condition.

FIG. 9 is an isometric view of the embodiment of FIG. 2 in a collapsed condition.

FIG. 10 is an isometric view of an alternative embodiment of a play yard in an unfolded condition.

FIG. 11 is an isometric view of the embodiment of FIG. 10 in a partially collapsed condition.

DESCRIPTION OF THE PREFERRED EMBODIMENT

Referring now to FIG. the play yard is an essentially rectangular apparatus that consists of a frame 12 and a fabric covering 14. Fabric covering 14 ensures that a child or infant placed within the play yard cannot come into direct contact with any of the locking or foldable segments of play yard frame 12. Padding (not shown) is selectively placed between structural sections of the play yard and the fabric covering to eliminate hard surfaces that may otherwise come into contact with a child or infant in the play yard. The padding is selectively placed so as not to interfere with the pivot points, allowing the play yard to be collapsed. A pad 16 is placed on the floor of the foldable play yard over the fabric covering 14. Pad 16 is removable and can be easily cleaned or replaced.

Figure 2:
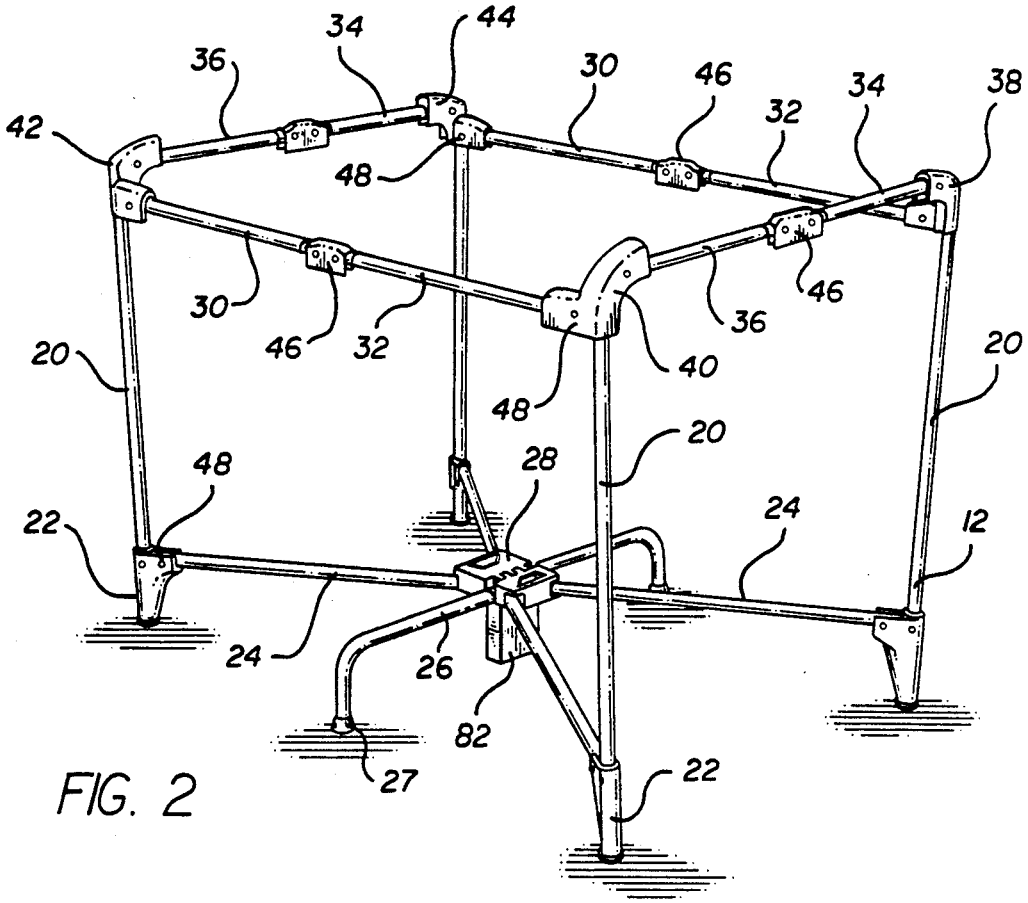
FIG. 2 is an isometric view of the frame of the play yard in a unfolded condition.

The frame 12 of the play yard is shown more clearly without fabric covering 14 in FIG. 2. The frame 12 consists of 4 vertical support legs 20 that are located at the 4 corners of the rectangle formed by the frame. An upper frame consisting of a number of support rods 30, 32, 34, and 36 extend between each of the vertical support members 20. The rods in the upper frame are of varying lengths. Upper frame rods 30 and 32 extend the length of the play yard. Upper frame rods 34 and 36 extend across the width of the play yard.

Figure 1:
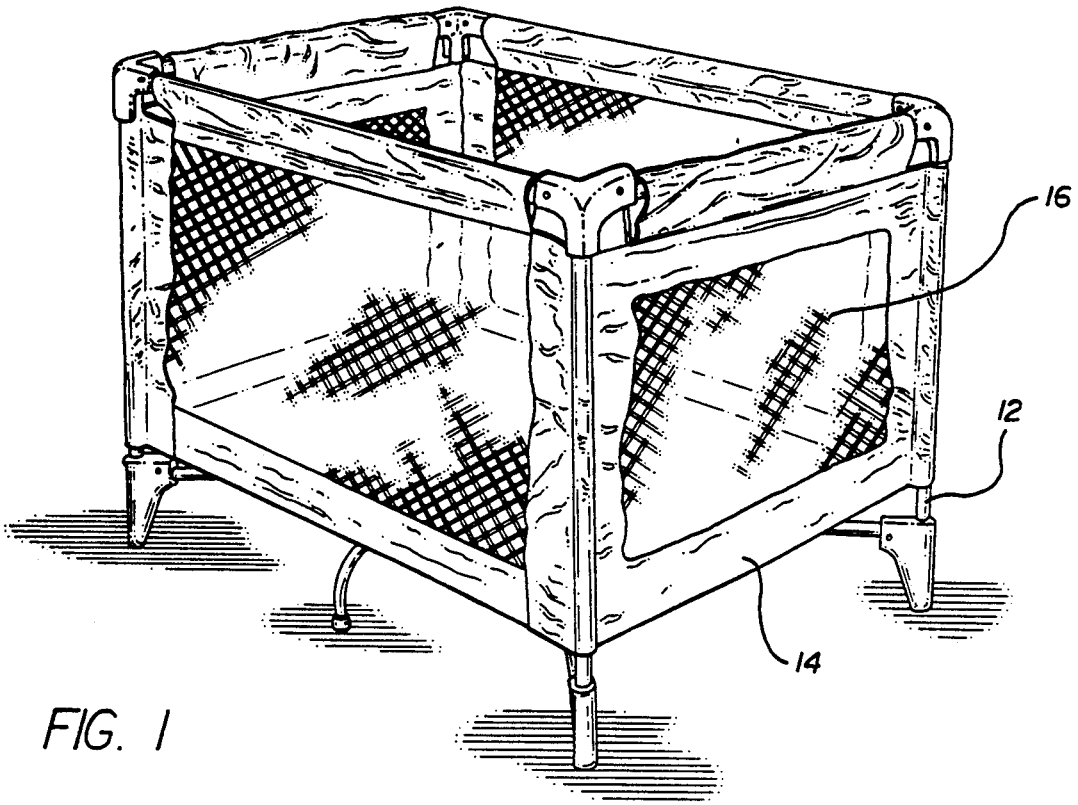
FIG. 1 is an isometric view of the play yard in a fully assembled condition.

Preferably, upper frame rods 30 and 32 are of the same length, and rods 34 and 36 are of the same length. This reduces the number of unique components that need to be manufactured for the play yard, reducing manufacturing costs thereof. A corner member is located atop each of the vertical support members 20. Corner members 38 and 42 are preferably identical as are corner members 40 and 44. This further reduces the number of different parts required to build the play yard, reducing the maintaining costs thereof. Each of the corner members is connected to and integral with the upper frame structure. The corner member extends above the vertical support members to cover any metal edges. As shown in FIGS. 1 and 2, the frame across the width of the play yard is raised above the frame across the length of the play yard. If desired, the length and width of the play yard can be the same height.

Rivets 48 connect the corner members with upper frame rods 30, 32, 34, and 36. This allows the upper frame to rotate about the rivets. The corner members are formed to accommodate movement of the upper frame. The movement permitted is restricted by the design of the play yard. The position substantially parallel to vertical support member 20 when the play yard is being stored or transported to a position substantially perpendicular to vertical support member 20 when the play yard is set up. A locking bracket 46 is located between upper frame rods 30 and 32 that run the length of the play yard, and between upper frame rods 34 and 36 which extend the width of the play yard. Locking members 46 are shown in the locked configuration in FIGS. 1 and 2 and is shown in more detail in FIG. 3. Locking members 46 can be rotated 180° to the unlocked position which can be seen in FIGS. 4 and 8. When all of the locking brackets 46 are in the locked position, the upper portion of the play yard frame becomes rigid, and will not move. When canvas material 14 is placed around the frame as shown in FIG. 1, the locking brackets 46 are covered by the play yard material 14. This prevents an infant or child within the play yard from being pinched by locking brackets 46, or from gaining direct access to the mechanism of locking bracket 46. This effectively prevents an infant or small child from placing their fingers into locking bracket 46.

In one embodiment, a central hub 28 is preferably located equidistant from each of the corner vertical supports 20. The central member is tied to the lower portion of each of the vertical supports 20 by an extension bar 24. Extension bar 24 is connected to each of the vertical support members 20 by a lower bracket 22. Lower bracket 22 is connected to vertical support member 20 and to extension bar 24 by rivets 48. Vertical support member 20 is attached to a fixed manner to lower bracket 22. This rivet arrangement is oriented to allow extension bar 24 to be rotated upwards until it is substantially parallel to vertical support member 20 when the play yard is folded up. This reduces the amount of space that the play yard will occupy during storage or transportation.

Referring to FIG. 8, the frame of the play yard is shown as it is being collapsed, placing the play yard in a folded condition. FIG. 8 illustrates pivoting of extension bars 24 with respect to lower brackets 22 and central hub 28. The lower brackets 22 also cover the end of vertical support members 20 to enclose any sharper metal edges and provide a non-skid surface.

A foldable central hub 28 is pivotally connected to extension bars 24 allowing extension bars 24 to pivot beneath central hub 28 as central hub 28 is raised. Extension bars are prevented from pivoting above central hub 28 by the design of central hub 28. Central hub 28 may be folded when the play yard is collapsed in order to ensure that the play yard occupy the least amount of space possible when it is collapsed. In the embodiment shown, the central hub 28 is divided longitudinally, along the lengthwise axis of the play yard.

Supplemental support members 26 are pivotally connected to central hub 28. Supplemental support members 26 extend laterally across the width of the play yard. Supplemental support members 26 are preferably located around the midpoint of the length of the play yard. Supplemental support members 26 provide additional support to the play yard when the play yard is opened as showing in FIGS. 1 and 2. Supplemental support member 26 rotate underneath central hub 28 when the play yard is collapsed, as shown in FIG. 8. Supplemental support members 26 are prevented from rotating above central hub 28 by the structure of central hub 28. Supplemental support members 26 are covered with feet 27 at the point where they come into contact with the ground or other surface. This provides protection from sharp or metal surfaces and provides a non-skid contact with the ground, floor, or other surface to prevent the from moving.

Figure 3:
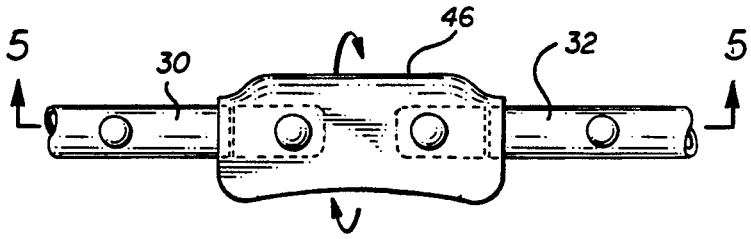
FIG. 3 is a side elevation view of the locking mechanism of the upper frame in a locked position.
Figure 4:
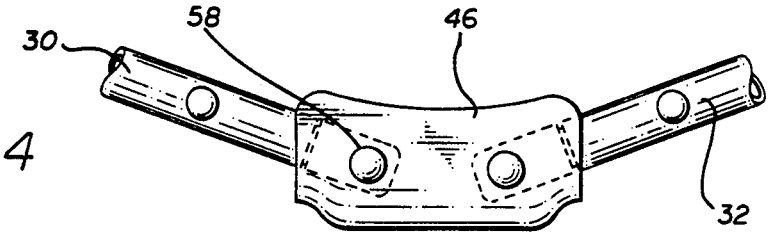
FIG. 4 is a side elevation view of the locking mechanism of the upper frame in an unlocked position
Figure 5:
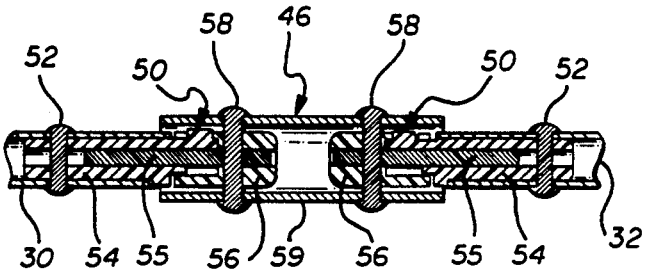
FIG. 5*a* is a cross-sectional view of the locking mechanism of the upper frame.
FIG. 5*b* is a perspective view of the locking mechanism of the upper frame.
Figure 5A:
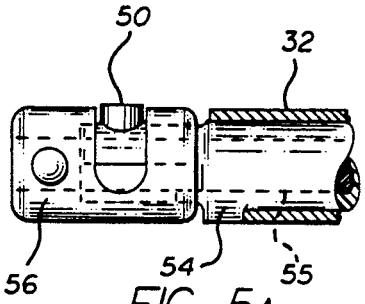

Locking bracket 46 is shown in more detail in FIGS. 3-5. Referring first to FIG. 3, the locking bracket 46 is shown in the locked position. Locking bracket 46 is a rotatable bracket that is pivotally attached to frame members 30 and 32 or 34 and 36 of the play yard.

The construction of locking member 46 and the interconnection between locking bracket 46 and upper frame members 30 and 32 is shown in FIG. 5.

Locking member 46 includes two identical, but complimentary assemblies which interface with the frame members. The apparatus as connected to frame member 32 will be explained in detail. Frame members 30, 34 and 36 are connected in an identical manner to locking member 46. The rotatable assembly connecting upper frame member 32 to locking member 46 includes several discrete components which may be formed of plastic or other flexible material, and one component which is preferably formed of metal or a more durable material. A movement limiting housing 56 is attached to a U-shaped bracket 59 by rivet 58. Rivet 58 may also be replaced by a nut and bolt, or other fastening device. Movement limiting member 56 includes a cutout area through which tab 50 protrudes. Tab 50 can only rotate within movement limiting segment 56 as far as the cutout allows.

Tab 50 is attached to or formed as part of rotating member 54. Rotating member 54 is affixed to upper frame member 32 by a rivet 52 which is located approximately two inches away from U-shape bracket 59 in one embodiment. It is recognized that rivet 52 can be replaced by a nut and bolt, or other suitable fastener. Rotatable member 54 thus interconnects the upper frame member 32 with movement limiter 56. Movement limiter 56 is then in turn attached to the U-shaped bracket 59. Thus, upper frame member 32 is attached to U-shape bracket 59.

Rotating member 54 may be solid, or may be a hollow tube formed of plastic or other suitable compound. In order to add strength to the rotating assembly which forms locking member 46, a reinforcing member 55 which may be a metal rod, may be located within the center of a hollow rotating segment 54. This reinforcing segment 55 may be formed of metal or other suitable structural component, and may be affixed to U-shape bracket 59 by rivet 58 as shown in FIG. 5. Preferably, this reinforcing member 55 extends into upper frame member 32 for some distance. In order to allow rotating member 54 to rotate within the scope allowed by movement limiter 56, it is necessary that the reinforcing member 55 end before rivet 52 which attaches the rotating segment 54 to the upper frame member 32.

Tab 50 of the present invention is implemented as a circular protrusion which rides within the groove of movement limiter 56. It is recognized that a square, rectangular or other shape may function in a similar manner, and may be suitable for use in the present invention. Tab 50 also has a flat surface at the end of the tab. This flat surface is intentionally designed, and protrudes from movement limiter 56 sufficiently to allow it to come in contact with U-shape bracket 59. U-shape bracket 59 is designed such that a flat surface exists adjacent to the resting position of tab 50 when locking member 46 is in the fully locked and fully unlocked positions. The flat surface of tab 50 will give the tactile feel of a positive lock when the tab rotates into a position where it is parallel to the flat sides of U-shape bracket 59. This is a valuable method of conveying to the user of the play yard that the locking member 46 has been properly rotated into the desired position, whether fully locked or unlocked.

An additional tab may be located on rotating member 54 in order to assist in assembling rotating member 54 and upper frame member 32. A corresponding notch may be located on upper frame member 32. This will serve to position the hole through rotating member 32 through which rivet 52 will be placed.

It is important for locking members 46 to be located immediately adjacent to segments 50 and 54 in order minimize the length of the tubing segment which must rotate in order to lock or unlock the upper frame of the play yard. This arrangement allows operation of the locking bracket 46 without having to rotate frame members 30, 32, 34, or 36. The amount of force required to rotate locking bracket 46 only needs to be exerted locally, at locking bracket 46. Additionally, the present design simplifies assembly and manufacture of locking bracket 46 and the associated components. There is no interference with adjacent supporting elements as the connection with locking bracket 46 is isolated to the area immediately surrounding locking bracket 46. This allows assembly of the remainder of the play yard to take place without regard for assembly of locking bracket 46.

Locking members 46 are effective because all of the frame members 30, 32, 34, and 36 are pivotally connected by rivets or screw 48 to corner members 38, 40, 42, and 44 such that frame members 30, 32, 34, and 36 are permitted to rotate downwards to a position substantially parallel to vertical support members 20. Locking bracket 46 is effective because it can be rotated to an unlocked position as shown in FIG. 4, which allows frame support members 30 and 32 or 34 and 36 to come together and become substantially parallel to each other. The direction that upper frame members 30 and 32 (or 34 and 36) are allowed to pivot within locking bracket 46 is designed complement to the direction that upper frame members 30 and 32 (or 34 and 36) are allowed to pivot by corner members 38, 40, 42, and 44. This allows vertical segments 20 and frame segments 30, 32, 34, and 36 to become substantially parallel when the play yard is folded up.

In the locked configuration as shown in FIG. 3, locking bracket 46 is rotated approximately 180° to inhibit the motion of upper frame support members 30 and 32 (or 34 and 36). Locking bracket 46 achieves this by restricting the direction that upper frame support members 30 and 32 are allowed to rotate with respect to rivets 58.

Additional structural integrity is provided by central hub 28. As shown in FIG. 6, central hub 28 provides for attachment of lateral extension bar 24 which extends to lower brackets 22 located at the bottom of vertical support members 20. Central hub 28 includes rivets 68 about which extension bars 24 can pivot.

Figure 7:
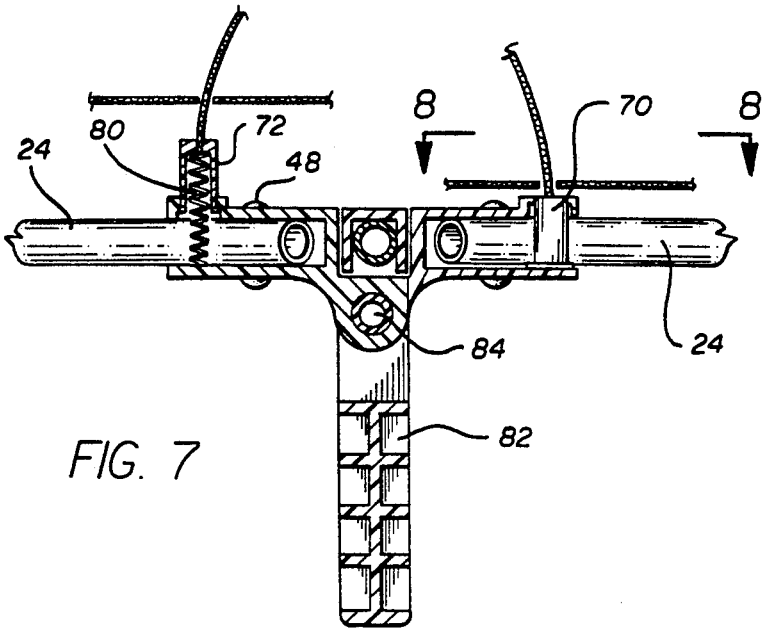
FIG. 7 is a cross-sectional view of the central member of the present invention.
Figure 12:
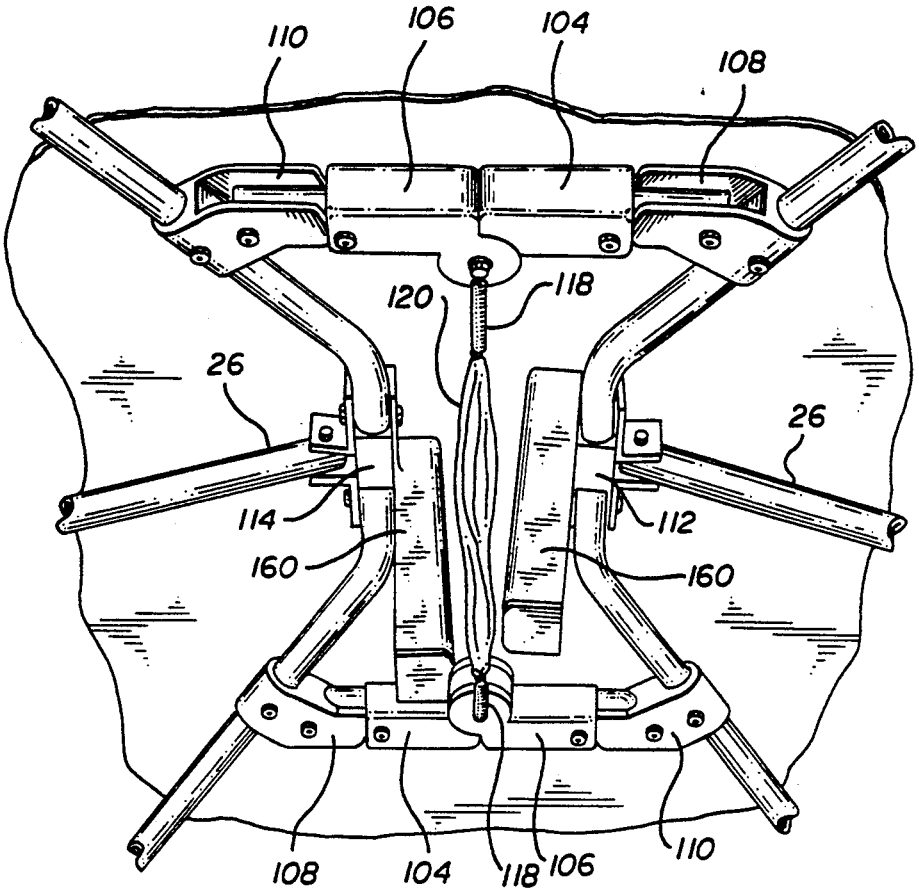
FIG. 12 an isometric view of the bottom of the play yard shown in FIG. 10 showing the longitudinal and cross support members.

In order to prevent unintended movement of lateral support members 24 which may tend to collapse the play yard, movement restrictors 70 and 72 are placed inside central hub 28. Movement restrictors 70 and 72 are spring loaded by a resilient member or spring 80 and require weight to be placed on top of them in order to hold them in position in between extension bars 24. When the play yard is assembled and a floor 16 placed in a play yard, the weight of the floor is sufficient to overcome the spring force of spring 80 driving the movement limiting members 70 and 72 in between extension bars 24. Motion limiter 72 is shown in FIG. 6 and FIG. 7 in a raised state in order to more clearly describe the present invention. A strap 76 is attached to movement limiting members 70 and 72. Strap 76 can be used to raise the motion limiting members 70 and 72 when desired in order to collapse the play yard. Strap 76 also provides a backup means of releasing motion restrictors 70 and 72 if spring 80 fails.

A cross-section of the central hub 28 is shown in FIG. 7. Central hub 28 also has a vertical support 82 integral with the central hub 28 in order to provide support for weight that is located towards the center of the play yard, away from the corner vertical support members 20 or supplemental support members 26. This further prevents the play yard from sagging in the center thereof.

Referring to FIGS. 10–13, there is shown an alternative embodiment to the embodiment shown in FIG. 1 and 2. In the embodiment shown in FIG. 10, the lengthwise and widthwise structural members which form the frame at the top of the play yard are all the same height. This allows corner pieces 102 to all be identical, whereas in the embodiment in FIG. 2, there must be at least two distinct corner pieces manufactured or molded in order to construct the play yard.

The lateral support members 30, 32, 34, and 36 are essentially the same as those shown in FIG. 2, and locking members 46 are identical to the locking members shown in FIG. 2. Similarly, vertical supports 20 and lower brackets 22 are identical to the configuration shown in FIG. 2.

Supplemental support members 26 shown in FIG. 2 are replaced with a supplemental support member 140 in FIG. 10 which has a curved base design. This avoids having the weight of the supplemental support resting on foot 27 which tends to cause the play yard to catch on carpets, and the like. An end cap 142 covers the sharp edges of supplemental support member 140. The curvature of supplemental support member 140 is determined by the particular weight bearing characteristics and strength of the material used to form supplemental support member 140. When using a stronger material, a sharper turn radius can be employed, and when using a weaker material, a more gradual curvature is necessary.

The length of supplemental support member 140 from the curvature to end cap 142 is preferably approximately 4–6 inches and the curvature has a diameter of approximately 5 inches. The exact length of this segment similarly depends on the particular material selected and the strength of that material. Supplemental support member 140, similar to supplemental support member 26, does not extend beyond the perimeter of the play yard defined by vertical support members 20.

In order to maintain all of the vertical and supplemental support members in position and maintain the shape of the lower portion of the play yard, two inner-longitudinal supports and two outer, cross supports are employed. The inner-longitudinal supports 112 and 114 provide a pivot point about which extending members 150, 152, 154 and 156 and supplemental support members 140 pivot. Longitudinal support 112 is connected to extension bars 154 and 156. When extended as shown in FIG. 10, longitudinal support 112 keeps extension bars 154 and 156 extended, maintaining a structure for the frame of the play yard. Longitudinal support 112 also provides a mounting and pivoting bracket for supplemental support 140. Longitudinal support 112 allows extension bars 154 and 156 to pivot when longitudinal support 112 is raised towards the top of the play yard. This allows the play yard to collapse into itself for ease of transportation. A partially collapsed play yard is shown in FIG. 11.

A leveling arm 160 is attached to one side of the interface of longitudinal support 112. Leveling arm 160 provides a standoff, allowing the play yard to retain a level bottom when the vertical support members 20 and leveling arms 160 are placed on a flat surface. Leveling arm 160 has a length which is designed to level extension arms 150, 152, 154, and 156, and keep them on the same plane. Leveling arm 160 is required to accommodate the height of lower brackets 22 which are located beneath vertical supports 20.

A similar longitudinal support 114 is pivotally connected to extension arms 150 and 152 on the opposite side of the play yard from longitudinal support 112. Longitudinal support 114 is also connected to a supplemental support member 140 and has a leveling arm 160 formed as part of longitudinal support 114 to provide a standoff.

The two longitudinal supports, 112 and 114 preferably divide the play yard into relatively equal segments along the longer axis of the play yard. In construction, longitudinal supports 112 and 114 can be identical for ease of manufacture, and to reduce the number of different parts manufactured for the assembly of the play yard. Longitudinal supports 112, 114 serve to maintain the rigidity of the length of the play yard when the play yard is opened as shown in FIG. 10.

Figure 13:
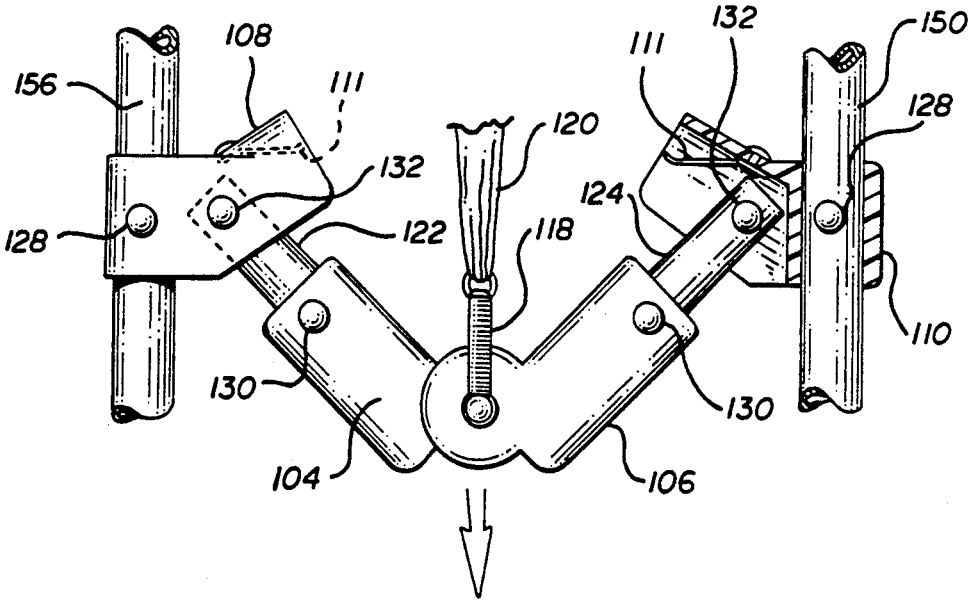
FIG. 13 is an isometric view of a cross support member.

In order to maintain the rigidity of the play yard in the widthwise direction, outer cross supports are located between extension bars 150 and 156, and between extension bars 152 and 154. These cross supports consist of a mounting bracket 108, two hinged intermediate members 104, 106, and mounting member 110. A section of tube 122, 124 is used to pivotally connect mounting brackets 108, 110 to the hinged members 104, 106. An expanded drawing of the cross support is shown in FIG. 13.

As described hereinabove, the longitudinal supports are depicted as inner support members, and the cross supports are depicted as outer members. It is recognized that the lateral supports can be modified to constitute outer members, and the cross supports modified to constitute inner members. It is preferable that leveling arms 160 be installed on the inner most support member in order to provide vertical support to the play yard from a point near the center of the play yard.

In one embodiment, a nut and bolt combination 49 attaches the upper frame members 30, 32, 34 and 36 of the embodiments shown in FIGS. 10 and 11 to the corner brackets 102. This allows the play yard to be disassembled, and the fabric covering 14 to be removed for cleaning.

Rivets or screws are employed as fasteners 128 to attach mounting brackets 108 and 110 to the extension bars. A similar rivet or screw is employed as fasteners 130 and 132 to attach extension tubes 122, 124 to hinged segments 104, 106, as well as to mounting brackets 108 and 110. Preferably, extension tubes 122 and 124 are identical in size, allowing fewer different components to be manufactured.

Two springs 118 and a sash 120 tie the two cross support members together. The tension of the springs pulls the two cross support members towards each other, causing them to lock, holding the extending bars in place. The cross supports are hinged so that they pivot outward as shown in FIG. 11. When the play yard is fully extended, the cross supports form a rigid member, preventing the extending bars from moving with respect to each other. By locating the cross supports along the extending bars away from the longitudinal supports, additional leverage is applied to the extending bars. In this manner, a greater strength is obtained for the weight of the component parts which are employed, providing superior structural integrity of the play yard.

A spring 111 is attached to bracket 108 as shown in FIG. 13. Spring 111 may be formed of spring steel or other suitable material, and applies a biasing force to segment 122 when the play yard is set up in the unfolded configuration, tending to force the outer bracket into a collapsed state. The rigid, or set-up condition of the play yard is maintained by the sash 120 and spring 118.

There has been described hereinabove a unique play yard having superior assembly characteristics, and providing greater protection against collapse than prior art devices of this type. Those skilled in the art may now make numerous uses of the inventive concept disclosed herein that are to be determined solely by the following claims.

What is claimed is:

1. A play yard comprising:

a frame including an upper frame structure and a lower frame structure;

said frame further comprising a plurality of vertical support members which separate the upper frame structure from the lower frame structure;

said upper frame structure determining the outer perimeter of the upper portion of the play yard, said upper frame structure pivotally attached to said plurality of vertical support members;

said lower frame structure determining the position of said vertical support members which in turn determine the perimeter of the lower portion of the play yard, said lower frame structure pivotally attached to said plurality of vertical support members;

at least two inner support members having locked and unlocked positions;

at least two outer support members having locked and unlocked positions;

lateral extension bars pivotally connecting said inner support members and said outer support members with the lower portion of said plurality of vertical support members, each of said lateral extension bars pivotally connected to at least one inner support member and at least one outer support member;

each inner support member connected to at least two lateral extension bars;

each outer support member connected to at least two lateral extension bars.

2. The play yard of claim 1 and further comprising:

a tension member interconnected between the outer support members tending to force said outer support members into the locked position, preventing collapse of said outer support members.

3. The play yard of claim 1 and further comprising at least one supplemental support member pivotally connected to each of said inner support members and spring means for biasing the outer support member from the locked position to an unlocked position.

4. The play yard of claim 1 and further comprising at least one supplemental support member pivotally connected to each of said outer support members.

5. The play yard of claim 1 and further comprising a standoff located on each of said inner support members raising said inner support members off of the ground such that said lateral extension bars are essentially parallel to the surface beneath the play yard.

6. The play yard of claim 1 and further comprising:

at least one standoff located on each of said outer support members for raising said outer support members up off the ground such that said lateral extension bars are substantially parallel to the ground when the play yard is open.

7. The play yard of claim 1 wherein said upper frame structure further comprises at least two upper frame rods along each side of said upper frame structure;

said upper frame structure further comprising:

a locking member pivotally connected between said upper frame rods in an area immediately adjacent to said locking member, said locking member having a locked position in which said upper frame rods are held substantially rigid, and an unlocked position in which said upper frame rods are free to pivot about said locking member;

corner members pivotally connected to said upper frame rods, and restricting movement of said upper frame rods to a predetermined range of substantially 90 degrees, such that upward movement of said upper frame rods connected to said locking members is limited by said corner members, and downward movement of said upper frame rods connected to said locking members is limited by said locking member when in the locked position, but downward movement of said upper frame rods to a position substantially parallel to said vertical support members is not limited by said locking member when in the unlocked position.

8. The play yard of claim 7 in which said locking member is connected to said upper frame rods by a fastener;

said fastener further comprising;

a rotating member which includes a protruding tab;

a movement limiter having a slot mating with the protruding tab at said rotating member forming a complementary mating fastener pair with said rotating member.

9. The play yard of claim 8 in which said movement limiter is affixed to said locking member and said rotating member is affixed to said upper frame rod.

10. The play yard of claim 1 in which said lower frame structure further comprises:

a fabric cover which substantially encloses the upper frame structure and the lower frame structure; and in which said upper frame rods are removably connected to said corner members, allowing said fabric covering to be removed from surrounding said play yard.

11. A play yard comprising:

a frame having a plurality of sides and including an upper frame structure and a lower frame structure;

said frame further comprising a plurality of vertical support members which separate the upper frame structure from the lower frame structure;

said upper frame structure determining the outer perimeter of the upper portion of the play yard, said upper frame structure pivotally attached to said plurality of vertical support members;

said lower frame structure determining the position of said vertical support members which in turn determine the perimeter of the lower portion of the play yard, said lower frame structure pivotally attached to said plurality of vertical support members;

said lower frame structure further comprising of lateral extension bars;

said upper frame structure further comprising at least two upper frame rods along each side of said upper frame structure;

a locking member pivotally connected between said upper frame rods, said locking member having a locked position in which said upper frame rods are held substantially rigid, and an unlocked position in which said upper frame rods are free to pivot about said locking member, said locking member pivotally connected to at least two upper frame rods such that each upper frame rod is free to pivot about said locking member independently of the other upper frame rod;

said upper frame structure further comprising corner members pivotally connected to said upper frame rods, and restricting movement of said upper frame rods to a predetermined range of substantially 90 degrees, such that upward movement of said upper frame rods connected to said locking members is limited by said corner members, and downward movement of said upper frame rods connected to said locking members is limited by said locking member when in the locked position, but downward movement of said upper frame rods to a position substantially parallel to said vertical support members is not limited by said locking members when in the unlocked position;

said lower frame structure further comprising:

at least two inner support members having locked and unlocked positions;

at least two outer support members having locked and unlocked positions; and lateral extension bars pivotally connecting said inner support members and said outer support members with the lower portion of said plurality of vertical support members, each of said lateral extension bars pivotally connected to at least one inner support member and at least one outer support member;

each inner support member connected to at least two lateral extension bars;

each outer support member connected to at least two lateral extension bars.

12. The play yard of claim 11 in which said locking member is connected to said upper frame rods by a fastener;

said fastener further comprising:

a rotating member which includes a protruding tab;

a movement limiter having a slot mating with the protruding tab at said rotating member forming a complementary mating fastener pair with said rotating member.

13. The play yard of claim 12 in which said movement limiter is affixed to said locking member and said rotating member is affixed to said upper frame rod.

14. The play yard of claim 11 in which said lower frame structure further comprises:

an outer cover which substantially encloses the upper frame structure and the lower frame structure; and in which said upper frame rods are removably connected to said corner members, allowing said outer cover to be removed from surrounding the play yard.

15. A play yard comprising:

a frame;

said frame further comprising a plurality of vertical support members;

an upper frame structure that determines the outer perimeter of the play yard, said upper frame structure pivotally attached to said plurality of vertical support members;

a central hub member;

lateral extension bars pivotally connecting said central base member with the lower portion of said plurality of vertical support members;

one or more movement limiters located intermediate said lateral extension bars;

said upper frame structure further comprising at least two upper frame rods along each side of said upper frame structure;

a locking member pivotally connected between said upper frame rods in an area immediately adjacent to said locking member, said locking member having a locked position in which said upper frame rods are held substantially rigid, and unlocked position, said locking member pivotally connected to each of said upper frame rods such that each upper frame rod is free to pivot about said locking member independently of the other upper frame rod; and a spring located between said movement limiter and said central base member tending to force said movement limiter away from its location intermediate said lateral extension arms.

16. The play yard of claim 15 in which said movement limiter is located within or upon said central base member.

17. The play yard of claim 15 in which said central base member is foldable.

* * * * *